US008402880B2

(12) United States Patent
Patel et al.

(10) Patent No.: US 8,402,880 B2
(45) Date of Patent: Mar. 26, 2013

(54) PACKING NUT LOCK AND ACCESS BORE COVER LOCKING ASSEMBLY

(75) Inventors: Pankaj H. Patel, Keller, TX (US); Mark D. Matzner, Burleson, TX (US)

(73) Assignee: S.P.M. Flow Control, Inc., Fort Worth, TX (US)

( * ) Notice: Subject to any disclaimer, the term of this patent is extended or adjusted under 35 U.S.C. 154(b) by 775 days.

(21) Appl. No.: 12/635,390

(22) Filed: Dec. 10, 2009

(65) Prior Publication Data

US 2010/0143163 A1 Jun. 10, 2010

Related U.S. Application Data

(60) Provisional application No. 61/121,464, filed on Dec. 10, 2008.

(51) Int. Cl.
*F15B 15/22* (2006.01)
*F16J 15/18* (2006.01)

(52) U.S. Cl. ..... 92/165 PR; 92/168; 417/572; 411/120

(58) Field of Classification Search ..... 92/168, 92/165 PR, 171.1; 403/362; 277/510, 511, 277/520; 411/116, 119, 120; 417/568
See application file for complete search history.

(56) References Cited

U.S. PATENT DOCUMENTS

| | | | | |
|---|---|---|---|---|
| 7,290,560 | B2 | 11/2007 | Orr et al. | |
| 7,335,002 | B2 * | 2/2008 | Vicars | 417/360 |
| 7,364,412 | B2 | 4/2008 | Kugelev et al. | |
| 7,404,704 | B2 | 7/2008 | Kugelev et al. | |
| 7,506,574 | B2 * | 3/2009 | Jensen et al. | 92/171.1 |
| 2011/0296982 | A1 * | 12/2011 | Dille et al. | 92/165 PR |

FOREIGN PATENT DOCUMENTS

| | | |
|---|---|---|
| JP | 08-159019 | 6/1996 |
| JP | 2004-162646 | 6/2004 |
| KR | 20-0178076 | 4/2000 |
| KR | 20-0275341 | 5/2002 |

OTHER PUBLICATIONS

International Searching Authority, International Search Report and Written Opinion, Jun. 16, 2010, International application No. PCT/US2009/067466.

* cited by examiner

*Primary Examiner* — Thomas E. Lazo
*Assistant Examiner* — Logan Kraft
(74) *Attorney, Agent, or Firm* — Bracewell & Giuliani LLP

(57) ABSTRACT

A retaining system for securing a closure at an installed position within a bore. The bore being in a portion of a housing and having screw threads along at least a portion thereof. The closure having an internally threaded hold extending therein. The closure in the installed position closes the bore. The retaining system comprising a retaining cover for obstructing removal of the closure from the bore. The retaining cover being receivable in the bore in a position generally adjacent the closure. The retaining cover having external threads interengageable with the screw threads of the bore such that the cover is rotatable relative to the housing in a tightening direction for movement of the cover into the bore toward the closure and rotatable in an opposite, loosening direction for movement of the cover out from the bore away from the closure. The cover having a central axis of rotation.

19 Claims, 8 Drawing Sheets

Fig. 10
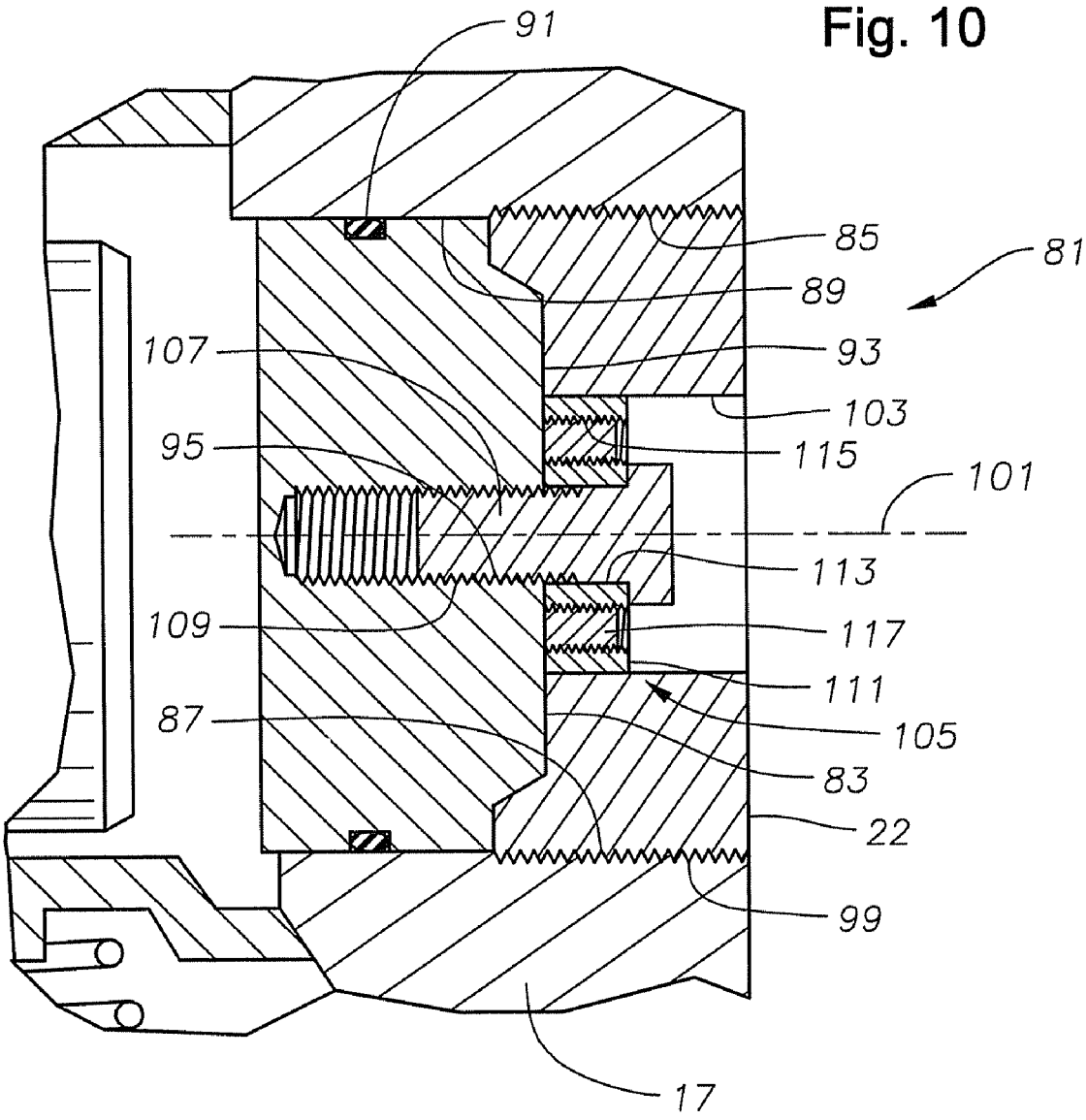
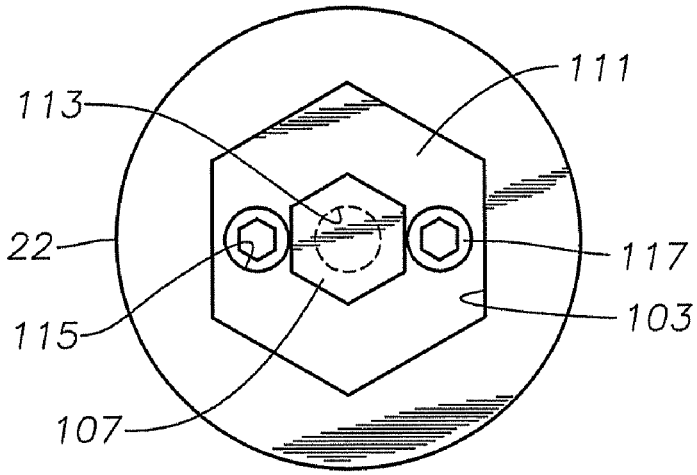
Fig. 11

PACKING NUT LOCK AND ACCESS BORE COVER LOCKING ASSEMBLY

This application claims priority to provisional application 61/121,464, filed Dec. 10, 2008.

FIELD OF THE INVENTION

The present invention relates in general to reciprocating pumps and, in particular, to a packing nut lock for a reciprocating pump and a system for holding a cover in position closing an access port of a pump housing.

BACKGROUND OF THE INVENTION

In oil field operations, reciprocating pumps are often used for various purposes. Some reciprocating pumps, generally known as "service pumps," are typically used for operations such as cementing, acidizing, or fracing a well. Typically, these service pumps run for relatively short periods of time, but they operate on a frequent basis. Often they are mounted to a truck or a skid for transport to various well sites. A pump might operate several times a week. In many applications, several pumps are connected in parallel to a single flow line.

High pressure pumps are widely used in the petroleum industry for a variety of field operations relating to oil and gas wells. Such pumps deliver a fluid or slurry, which may carry solid particles (e.g., a sand proppant), at pressures up to 20,000 psi. A common type is a positive displacement pump having one or more plungers reciprocally movable in a corresponding pump chamber. Each chamber has an intake port for receiving fluid, a discharge port for exhaust, and a one-way flow valve in each port for preventing reverse flow. These valves require frequent maintenance. Components of the valves are formed of a material which forms an effective seal, such as polyurethane, but which is incapable of withstanding the erosive environment of the pump chamber for an extended duration. Typically, each valve must be serviced after every period of continuous operation at a well site (e.g., every four to six hours) for replacement of worn components. An access port is provided in a wall of the pump housing, at a location near the valves, so that maintenance personnel can readily reach the valves.

The access port must be securely closed and sealed for proper operation of the pump. A closure device, such as a plug with a circumferential seal, is provided for installation in the access port. A retaining cover is typically secured in the access port behind the closure to thinly hold the closure at its installed position. The retaining cover has external threads and is rotatably received in a threaded portion of the access port. Typically, a worker tightens the retaining cover in the access port to a high torque using a sledge hammer and a tool placed in a cavity of the cover to effect its rotation.

Unfortunately, the retaining cover is subject to inadvertently loosen. The pump experiences substantial vibration during operation at high power settings such that the retaining cover can overcome its initially applied torque and begin to "back out", or rotate in the access port in a loosening direction. Should the retaining cover continue to loosen, the closure and a quantity of high pressure fluid would be ejected from the pump housing and potentially cause damage or injury. Consequently, safety regulations demand that operators respond to any loosening of the retaining cover by stopping the pump. That degrades efficiency and can necessitate the expense of a back-up pump for continuing a pumping operation while the primary pump is shut down.

SUMMARY OF THE INVENTION

A retaining system for securing a closure at an installed position within a bore. The bore is positioned within a portion of a housing. The bore has screw threads along at least a portion of the bore. The closure has an internally threaded hole extending into the closure. The closure, when positioned in the installed position, closes the bore.

The retaining system has a retaining cover for obstructing removal of the closure from the bore. The cover is receivable in the bore in a position generally adjacent to the closure. The cover has external threads that are interengageable with the screw threads of the bore such that the cover is rotatable relative to the housing in a tightening direction for movement of the cover into the bore toward the closure and rotatable in an opposite, loosening direction for movement of the cover out from the bore away from the closure. The cover has a central opening extending therethrough that defines an internal wall along the opening. The cover also has a central axis of rotation.

The retaining system also has a locking member configured for being secured to the cover, the locking member has an outer surface which forms a radial abutment to the opening of the cover, and against rotation of the cover relative to the locking member. The locking member has a central clearance bore located in and extending therethrough. A plurality of apertures are located in and extend through the locking member at intervals surrounding the central clearance bore, each aperture having threads extending along its inner surface. A set screw is positioned within each of the plurality of apertures. Each of the set screws has threads interengageable with the threads of the plurality of apertures to allow for the plurality of set screws to be tightened into engagement with the closure, thereby preventing rotation of the locking member relative to the closure.

A fastener is receivable in the central clearance bore of the locking member and the hole of the closure and has external threads interengageable with the threads of the hole in the closure. The threads of the cover and the threads of the fastener are spiraled in the same direction. The cover is securely threaded into the housing. The locking member is inserted into the central opening of the cover, and the faster is inserted through the central clearance bore of the locking member and threaded into the internally threaded hole of the closure, thereby securing the locking member in abutting contact with the closure. The set screws of the locking member are then engaged with the closure, thereby preventing rotation of the locking member relative to the closure, and thus, preventing rotation of the cover relative to the housing.

A retaining system for securing a packing nut at an installed position within a bore. The bore is located in a portion of a housing and has a central axis. The bore has threads along at least a portion thereof. An elongated member extends axially through the bore and is capable of movement along the axis. Packing is positioned between the inner surface of the bore and the member. The packing nut has a plurality of apertures located in the outer peripheries thereof at an angle transverse to the axis. The packing nut in the installed position has threads engaged with the threads of the bore, thereby retaining the packing between the bore and the member.

The retaining the system has a locking device. The locking device has a substantially cylindrical portion that is adapted to be positioned within at least one of the plurality of apertures of the locking nut, thereby connecting the locking device to the packing nut. A plurality of apertures are located in and extend through the locking device at an angle substantially parallel to the axis when the locking device is connected to the packing nut. A set screw is positioned within each of the plurality of apertures of the locking device. The plurality of set screws have threads interengageable with the threads of the plurality of apertures of the locking device to allow for the plurality of set screws to be tightened into engagement with the housing, thereby preventing rotation of the locking device relative to the housing, and thus, preventing the packing nut from rotating relative to the housing when the locking device is connected to the packing nut.

BRIEF DESCRIPTION OF THE DRAWINGS

FIG. 10 is an enlarged view of a portion of the pump assembly shown in FIG. 9;

FIG. 11 is an end view of the suction cover of FIGS. 9 and 10.

DETAILED DESCRIPTION OF THE INVENTION

Figure 1:
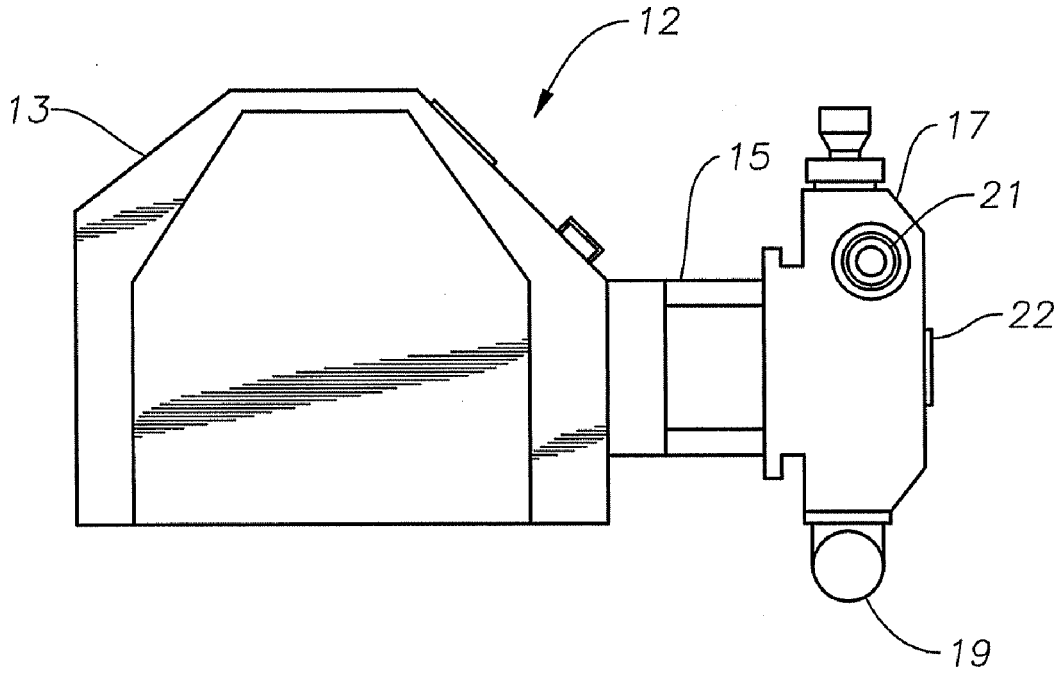
FIG. 1 is an elevational view of a reciprocating pump assembly constructed in accordance with the present invention.
Figure 3:
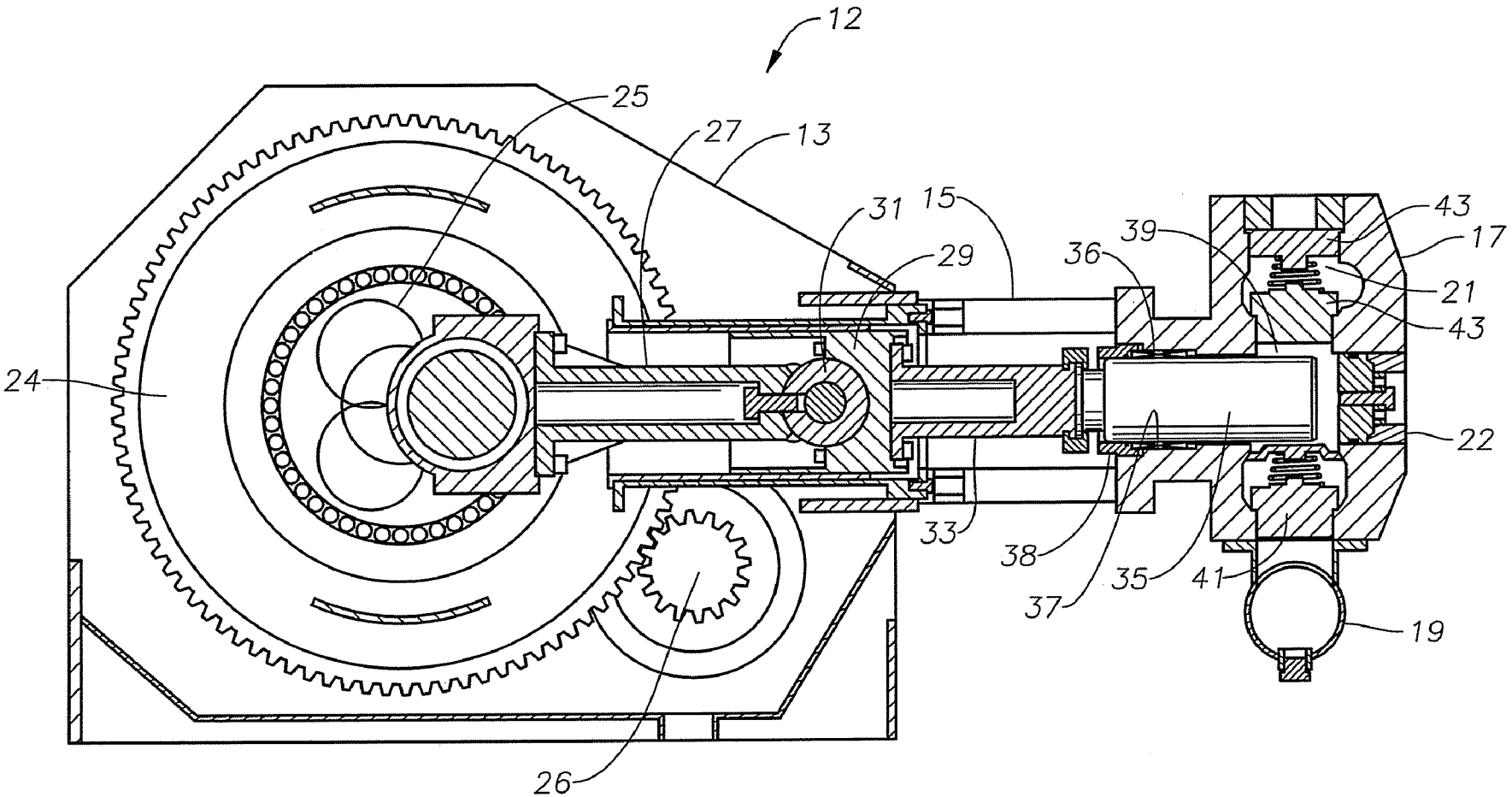
FIG. 3 is a sectional view of a portion of the pump assembly shown in FIG. 1.
Figure 4:
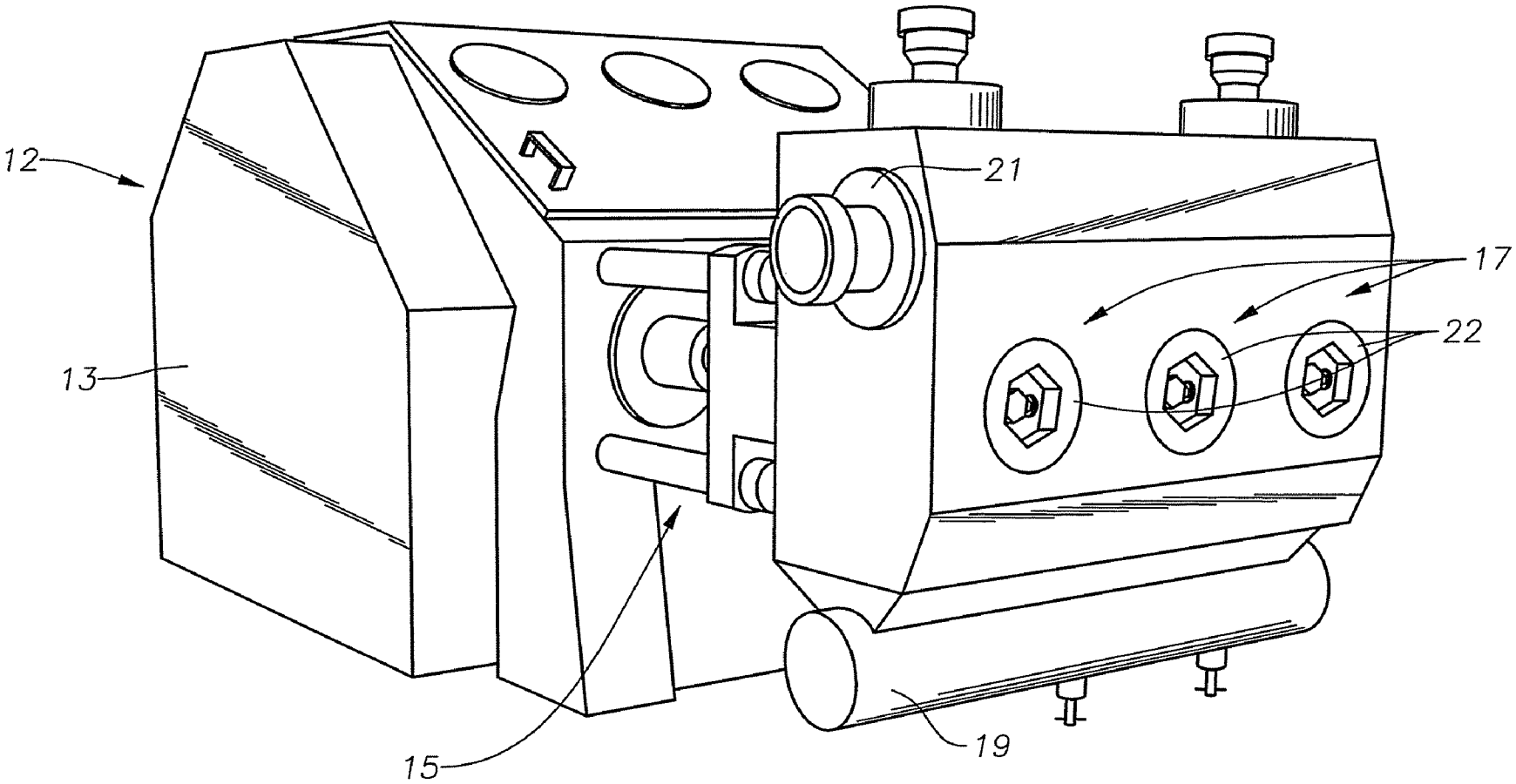
FIG. 4 is a perspective view of the reciprocating pump assembly shown in FIG. 1.
Figure 9:
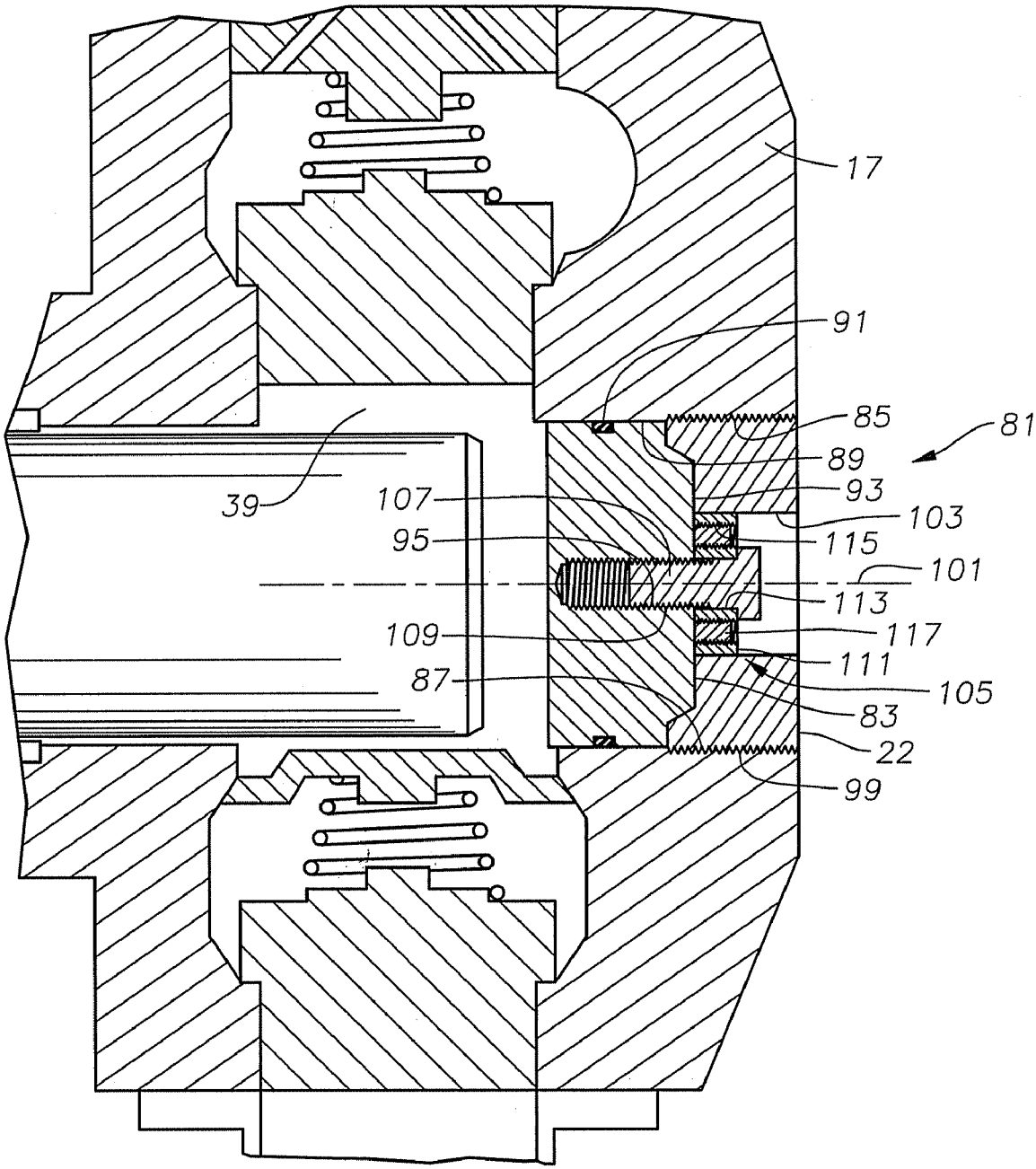
FIG. 9 is an enlarged view of a portion of the pump assembly shown in FIG. 3.

Referring to FIGS. 1 and 3, a reciprocating pump assembly or pump 12 includes a crankshaft housing 13 that comprises a majority of the outer surface of reciprocating pump 12. A plurality of stay rods 15 attach to a side of crankshaft housing 13 and extend to a fluid cylinder housing 17. Each cylinder typically includes a fluid inlet 19 and a fluid outlet 21. As best shown in FIGS. 3 and 9, an access bore cover 22 connects to an end of cylinder housing 17 opposite the plurality of stay rods 15. While pump 12 is shown in FIG. 4 as freestanding on the ground, pump 12 can easily be mounted to a trailer that can be towed between operational sites, or to a skid such as for offshore operations. Accordingly, a pump assembly may include a pump 12 mounted directly to the ground or a support structure, a skid, a trailer, etc.

Figure 2:
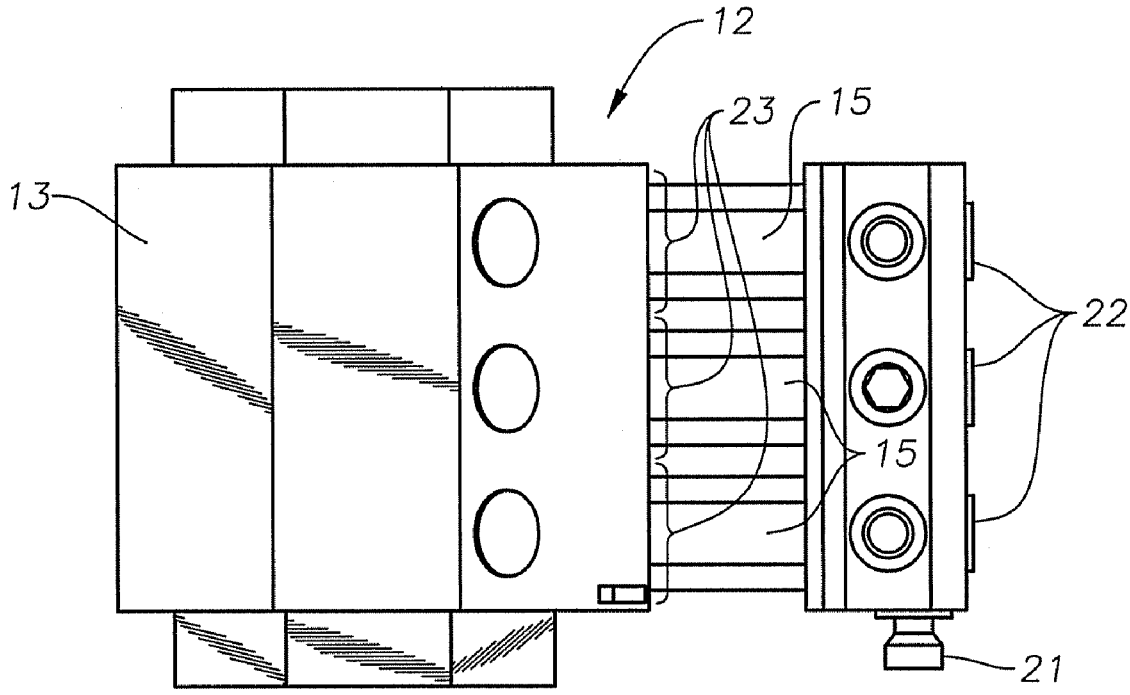
FIG. 2 is a top plan schematic view of the reciprocating pump assembly of FIG. 1.

Referring to FIG. 2, stay rod 15 is segmented into three portions, and each portion comprises a plunger throw 23. Reciprocating pump 12 (as shown in FIG. 2) has three plunger throws 23, which is commonly know as a triplex, but could also be segmented for five plunger throws 23, which is commonly known as a quintuplex pump. The present description is directed to a triplex pump, but as will be readily apparent to those skilled in the art, the features and aspects described are easily applicable for a quintuplex pump or still other types of pumps. Each plunger throw 23 houses a plunger or pony rod 33 (FIG. 3) extending to cylinder housing 17. As shown in FIG. 2, each plunger throw 23 extends in the same longitudinal direction from crankshaft housing 13.

Referring to FIG. 3, a portion of reciprocating pump 12 housed within crankshaft housing 13 is shown. Crankshaft housing 13 houses a crankshaft 25, which is typically mechanically connected to a motor (not shown). The motor rotates crankshaft 25 in order to drive reciprocating pump 12. In one embodiment, crankshaft 25 is cammed so that fluid is pumped from cylinder housing 17 at alternating times. As is readily appreciable by those skilled in the art, alternating the cycles of pumping fluid from cylinder housing 17 helps minimize the primary, secondary, and tertiary (et al.) forces associated with reciprocating pump 12.

In one embodiment, a gear 24 is mechanically connected to crankshaft 25 and is rotated by the motor through gears 26 and 24. A connector rod 27 connects to a crosshead 29 through a crosshead pin 31, which holds connector rod 27 longitudinally relative to crosshead 29. Connector rod 27 pivots about crosshead pin 31 as crankshaft 25 rotates with the other end of connector rod 27. Pony rod 33 extends from crosshead 29 in a longitudinally opposite direction from crankshaft 25. Connector rod 27 and crosshead 29 convert rotational movement of crankshaft 25 into longitudinal movement of pony rod 33.

A plunger 35 is connected to pony rod 33 for pumping the fluid passing through cylinder housing 17. Packing 36 surrounds plunger 35. A packing nut 38 is threaded into cylinder housing 17, and acts to maintain packing 36 in the proper position within packing bore 37. A number of holes or apertures 40 (FIGS. 7 and 8) extend along the outer diameter of the rim of packing nut 38. Holes 40 are for engagement by a spanner to tighten and loosen packing nut 38. When properly positioned, packing 36 and packing nut 38 maintain the necessary pressure between plunger 35 and bore 37 and prevent packing bore 37 from leaking. Cylinder housing 17 connects to the ends of stay rods 15 extending away from crankshaft housing 13 (FIG. 1). Cylinder housing 17 includes a plurality of interior or cylinder chambers 39, which is where plungers 35 compress the fluid being pumped by reciprocating pump 12. Cylinder housing 17 also typically includes an inlet valve 41 and an outlet valve 43. Valves 41, 43 are usually spring-loaded valves and are actuated by predetermined differential pressure. Inlet valve 41 actuates to control fluid flow through fluid inlet 19 into cylinder chamber 39, and outlet valve 43 actuates to control fluid flow through fluid outlet 21 from cylinder chamber 39. Other valve arrangements and configurations of the fluid end do not depart from the scope of this invention.

Plunger 35 reciprocates, or moves longitudinally toward and away from cylinder housing 17, as crankshaft 25 rotates. As plunger 35 moves longitudinally away from cylinder chamber 39, the pressure of the fluid inside chamber 39 decreases, creating a differential pressure across inlet valve 41, which actuates valve 41 and allows and allows the fluid to enter cylinder chamber 39 from fluid inlet 19. The fluid being pumped enters cylinder chamber 39 as plunger 35 continues to move longitudinally away from cylinder housing 17 until the pressure difference between the fluid inside chamber 39 and the fluid in fluid inlet 19 is small enough for inlet valve 41 to actuate its closed position. As plunger 35 begins to move longitudinally towards cylinder housing 17, the pressure on the fluid inside of cylinder chamber 39 begins to increase. Fluid pressure inside cylinder chamber 39 continues to increase as plunger 35 approaches cylinder housing 17 until the differential across outlet valve 43 is large enough to actuate valve 43 and allow the fluid to exit cylinder housing 17 through fluid outlet 21. In one embodiment, fluid is only pumped across one side of plunger 35, therefore reciprocating pump 12 is a single-acting reciprocating pump. As the operation of pump 12 is conventional, it will not be described in further detail. During operation of pump 12, vibration and reciprocating forces from plunger 35 may cause packing nut 38 to loosen or back out. As packing nut 38 backs out, packing 36 is affected, resulting in pressure differentials and leaking of packing bore 37.

Figure 5:
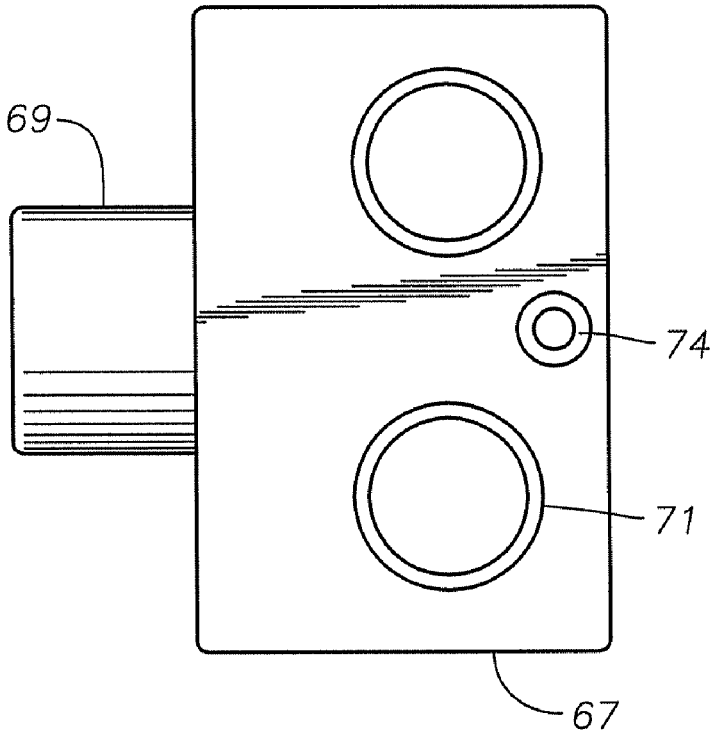
FIG. 5 is a front plan view of a packing nut lock as constructed in accordance with the present invention, without set screws.
Figure 6:
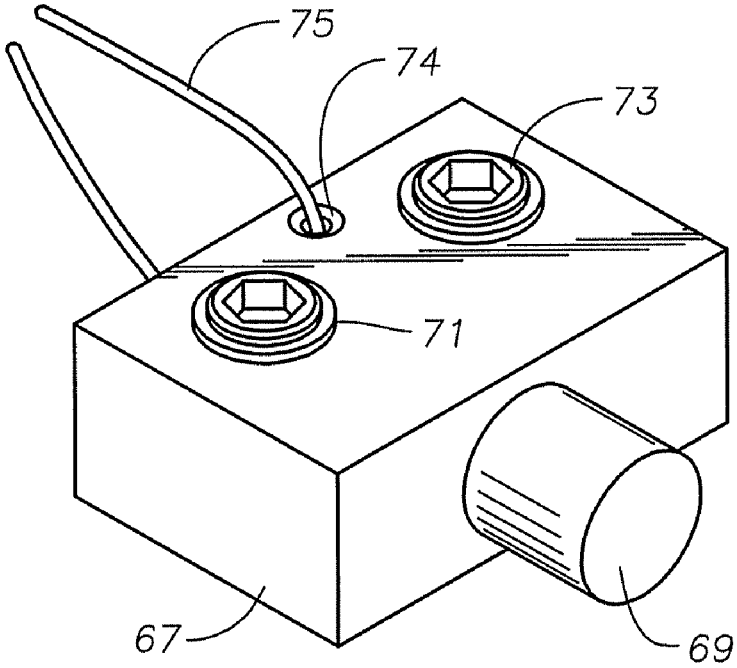
FIG. 6 is a perspective view of a packing nut lock as constructed in accordance with the present invention.

Referring to FIGS. 5 and 6, a packing nut lock 67 is comprised of a main body with a cylindrical pin section 69 that extends from the main body. Positioned above pin section 69 are two threaded apertures 71 that extend through the main body of packing nut lock 67. Threaded apertures 71 are designed to accept threaded set screws 73 (FIG. 6). A small aperture 74 may be positioned above apertures 71 and extends through the main body of packing nut lock 67. A looped cable 75 may be attached to the main body of packing nut lock 67 through aperture 74 (FIG. 6).

Figure 7:
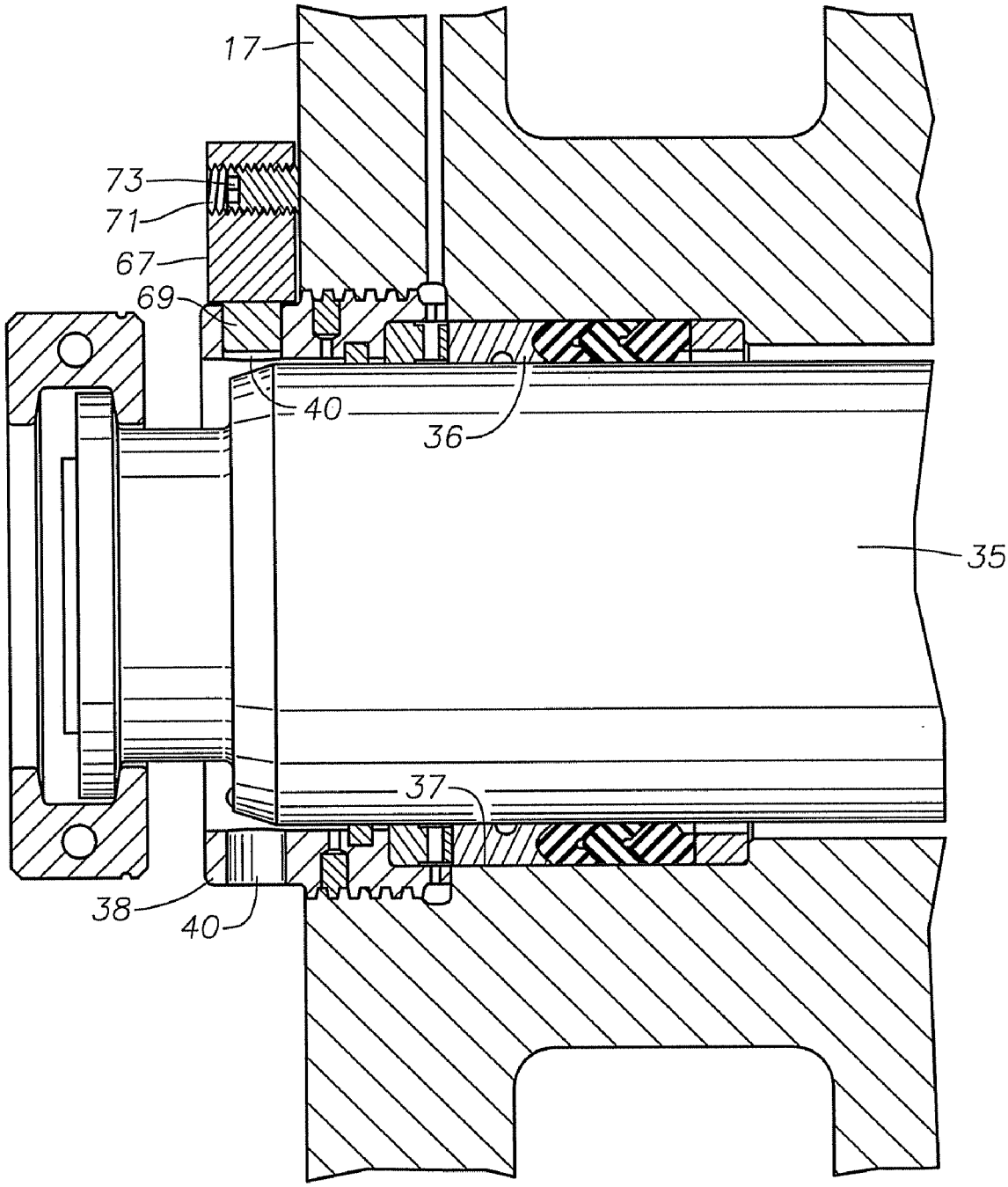
FIG. 7 is a sectional view of a portion of a reciprocating pump assembly constructed in accordance with the present invention, with a packing nut lock installed.
Figure 8:
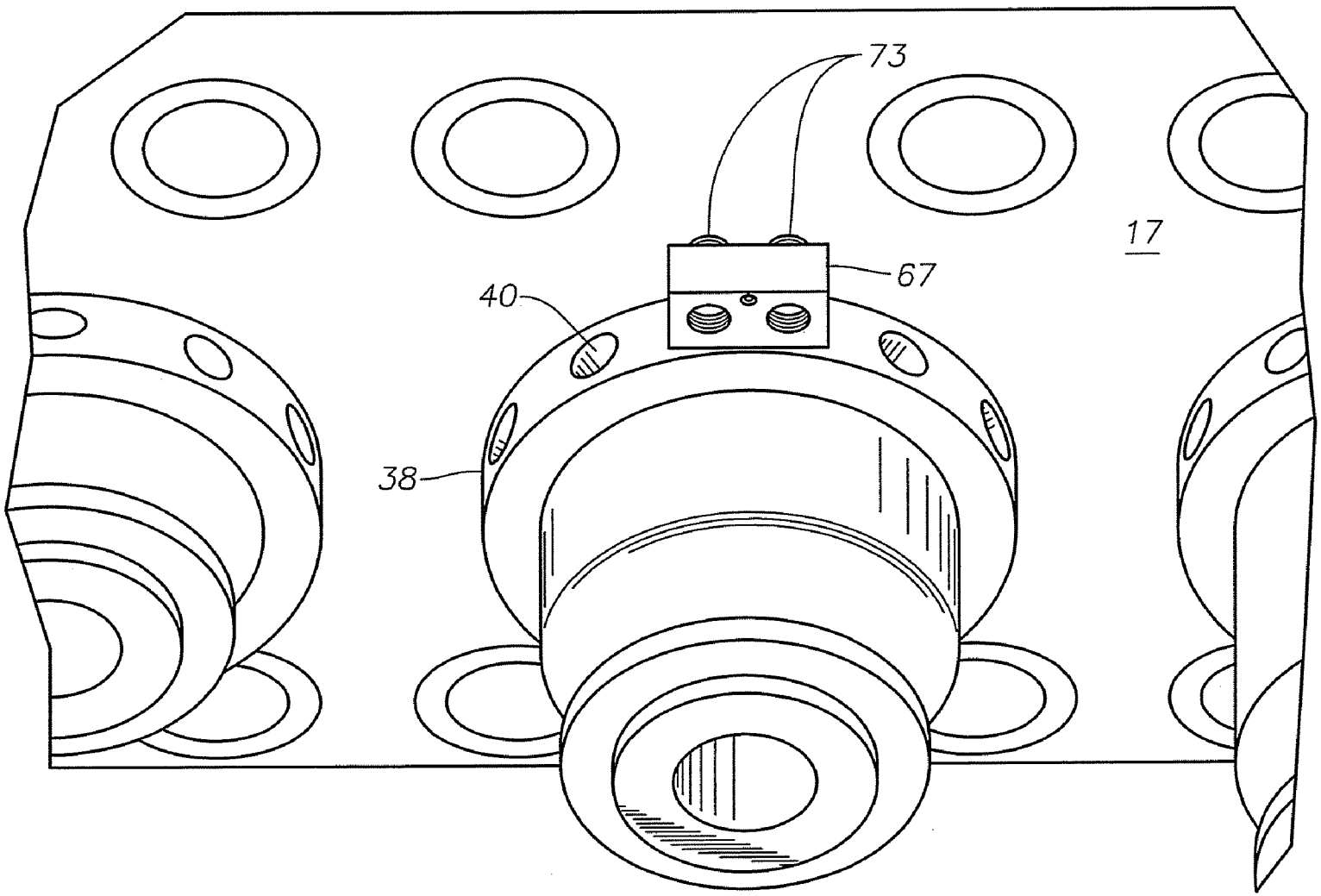
FIG. 8 is a perspective view of a portion of a reciprocating pump assembly constructed in accordance with the present invention, with a packing nut lock installed.

Referring to FIG. 7, in operation, once packing 36 has been inserted around plunger 35, within packing bore 37, packing nut 38 is threaded into the body of cylinder housing 17. Referring generally to FIGS. 7 and 8, a spanner (not shown) is inserted into holes or apertures 40 on the outer diameter of the rim of packing nut 38, and packing nut 38 is securely tightened. Packing nut lock 67 is then attached to packing nut 38 (FIG. 7). The cylindrical portion 69 is machined to fit into one of the holes 40 extending around the rim of packing nut 38. Packing nut 38 is positioned so that pin portion 69 is within hole 40, and the main body of packing nut is positioned such that apertures 71 and set screws 73 are substantially perpendicular to the wall of cylinder housing 17 (FIG. 7). Set screws 73 are tightened to a suitable force against the wall of cylinder housing 17, acting to lock packing nut lock 67 to housing 17, preventing it from rotating relative to housing 17.

The engagement of set screws 73 with cylinder housing 17 locks packing nut lock 67 to cylinder housing 17, and prevents it from rotating relative to housing 17, thereby also preventing packing nut 38 from rotating relative to housing 17. As a result, packing nut lock 67 prevents packing nut 38 from loosening and backing out. Cable 75 (FIG. 6) may be connected to packing nut lock 67 through aperture 74, and allows packing nut lock 67 to be secured to cylinder housing 17 or pump 12 while the operator is tightening packing nut 38.

Referring now to the drawings and in particular to FIGS. 9 and 10, a retaining system according to the present invention is indicated in its entirety at 81. Retaining system 81 secures a closure 83 within a bore 85 to close bore 85. The system is particularly adapted for holding plug member 83 in maintenance access bore 85 of high pressure reciprocating pump 12. Housing 17 of the fluid end includes an access port, defined by bore 85, for each chamber 39 to facilitate maintenance actions on the fluid end of pump 12. Specifically, the access port is located near one-way valves 41, 43 so that maintenance personnel can reach valves 41, 43 to replace worn components. Access port bore 85 includes a threaded, outer portion 87 and a smooth (non-threaded), inner portion 89, as shown in FIGS. 9 and 10. In the embodiment shown in the drawings, outer portion 87 is axially aligned with inner portion 89. Inner 89 and outer 87 portions, as can be seen, are formed from a single unitary portion of housing 17. Closure 83 comprises a plug member having a size and cylindrical shape corresponding with inner portion 89 of bore 85 for being received in inner portion 89 to an installed position for closing pump chamber 39. Closure 83 is at times referred to by those skilled in the art as a "suction valve cover". A circumferential seal 91 is received in a groove around closure 83 for sealing engagement against the surface of inner portion 89 of bore 85 to prevent leakage of fluid through access port bore 85 when closure 83 is at its installed position. Closure 83 has an outer face 93 having a threaded hole 95 in its center which extends into closure 83 but does not extend completely through closure 83.

Access bore cover or retaining cover 22 (broadly, a "retainer") has a size and shape corresponding with outer portion 87 of bore 85 and is received in outer portion 87 for holding closure 83 at its installed position. Cover 22 has external threads 99 which are interengageable with the threads of outer portion 87 of bore 85. Cover 22 is rotatable relative to housing 17 about a central axis 101 in a tightening direction toward closure 83 and into housing 17, and in a loosening direction away from closure 83 and out from housing 17. When positioned in bore 85, cover 22 obstructs removal of closure 83 from bore 85. A central opening 103 extends through cover 22 and defines an internal wall. In one embodiment, central opening 103 has a polygonal (e.g., hexagonal) shape.

A locking device designated generally at 105 is provided for preventing inadvertent rotation of cover 22. Locking device 105 comprises a fastener 107 which is received in threaded hole 95 of outer face 93 of closure 83. In one embodiment, fastener 107 is aligned with central axis 101 when secured. Fastener 107 illustrated in FIGS. 9 and 10 comprises a bolt having external threads 109 interengageable with the threads of hole 95. For securing fastener 107 to cover 22, locking device 105 further comprises a locking member 111 receivable in central opening 103 of cover 22. In one embodiment, locking member 111 is in the form of a nut having a polygonal (e.g., hexagonal) outer surface for nesting engagement with the internal wall of cover 22 (FIG. 11) and a clearance bore 113 having a circular inner surface for receiving bolt 107. Locking member 111 has a plurality of apertures or bores 115 located in and extending therethrough. In this embodiment, two apertures 115 are located on opposite sides of central opening 103. Each aperture 115 has threads along its inner surface. A set screw 117 is contained within each aperture 115 and is interengageable with the threads on the inner surface of each aperture 115 (FIG. 11). Set screws 117 are engaged with the outer face 93 of closure 83. Thus, as described above and shown in the figures, locking member 111 has an outer surface which forms a radial abutment (1) to the internal wall of cover 22 and (2) against a rotation of cover 22 relative to said locking device 105. Thus, when locking member 111 is in nested engagement with cover 22, locking member 111 and cover 22 cannot be rotated in opposite radial directions at the same time (FIG. 11).

Bolt 107 is inserted through bore 113 of locking member 111 and threaded into hole 95 of closure 83. Bolt 107 is tightened to a suitable torque such that the head of bolt 107 applies substantial force against locking member 111. Set screws 117 are tightened to a suitable force against face 93 of closure 83, and consequently, locking member 111 and closure 83 are firmly secured together. Locking device 105 is compatible with existing pump equipment. Although the locking device of the illustrated embodiment has two parts, it is understood that the locking device may have more or fewer parts without departing from the scope of this invention.

Significantly, threads 99 of cover 22 and threads 109 of fastener 107 are spiraled in the same direction. In one embodiment, cover 22 and its corresponding outer portion 87 of access port 85, and the fastener 107 and its corresponding threaded hole 95 are right-hand threaded. Therefore, the loosening direction for cover 22 and bolt 107 is typically a counter-clockwise rotational direction. The form of threads 99, 109 is conventional and of a suitable standardized type and pitch. It is understood that cover 22 and fastener 107 may be left-hand threaded without departing from the scope of this invention.

In operation, pump 12 may generate vibrations when operating at high power settings which tend to loosen cover 22 in its threaded engagement with access port bore 85. Locking device 105 prevents rotation of cover 22 in the loosening direction. Closure 83 does not rotate relative to housing 17 due to friction between closure 83 and bore 85 and due to the mass of closure 83. Frictional forces also act along the outer surface of closure seal 89. The frictional engagement between set screws 117 and face 93 of closure 83, prevents rotation of locking member 111. The nesting engagement of locking member 111 within central opening 103 of cover 22 prevents locking member 111 and cover 22 from rotating relative to one another. The tendency of cover 22 to loosen has insufficient torque to overcome the frictional engagement of set screws 117 of locking member 111 with face 93 of closure 83, thereby preventing rotation of locking member 111, and thus stopping the rotation of cover 22. Consequently, the need to shut down pump 12 due to a loosening cover is precluded.

The invention has several advantages. By eliminating backing off of the packing nut, necessary pressures are maintained between the plunger. Additionally, the incorporation of the packing nut lock helps to prevent the packing bore from leaking due movement of the packing and the backing off of the packing nut. The suction cover locking device helps to prevent rotation of the suction cover and the withdraw of the plug member from within the access bore.

While the invention has been shown or described in only some of its fauns, it should be apparent to those skilled in the art that it is not so limited, but is susceptible to various changes without departing from the scope of the invention.

The invention claimed is:

1. An apparatus for retaining a threaded nut in engagement with a threaded bore in a reciprocating pump housing of a reciprocating pump, the apparatus comprising:

a block having a portion in engagement with the nut;

a pair of threaded holes located in and extending through the block; and a set screw positioned within each threaded hole and rotatable relative to the block, each set screw bearing against and being in frictional engagement with a non-rotatable portion of the reciprocating pump to prevent rotation of the block relative to the pump housing, which in turn, prevents the threaded nut from rotating relative to the pump housing.

2. The apparatus of claim 1, wherein the threaded nut has a polygonal shaped central opening extending therethrough defining an internal wall along the opening; and wherein the block is polygonal in shape and is positioned within the central opening in nesting engagement with the threaded nut preventing rotation of the threaded nut and block relative to one another; and further comprising:

a closure positioned within the bore that acts to close the bore, the closure having an internally threaded hole extending therein;

a central clearance bore located in and extending through the block; and a fastener extending through the central clearance bore of the block and threadably engaged with the hole of the closure; and wherein each set screw bears against and is in frictional engagement with the closure.

3. The apparatus of claim 1, wherein the bore has a central axis and the threaded nut has a plurality of apertures located in the outer peripheries of the threaded nut at an angle transverse to the axis; and further comprising:

an elongated member extending axially through the bore; the member being capable of movement along the axis;

packing positioned between the bore and the member, the threaded nut retaining the packing between the bore and the member; and wherein the block has a substantially cylindrical portion that is geometrically complimentary to and is positioned within at least one of the plurality of apertures of the threaded nut to thereby connect the block to the threaded nut; and each set screw bears against and is in frictional engagement with the pump housing.

4. A retaining system for securing a packing nut at an installed position within a bore, the bore being in a portion of a housing and having a central axis, the bore having threads along at least a portion of the bore, an elongated member extending axially through the bore, the member being capable of movement along the axis, packing positioned between the bore and the member, the packing nut having a plurality of apertures located in the outer peripheries of the packing nut at an angle transverse to the axis, the packing nut in the installed position having threads engaged with the threads along at least a portion of the bore, thereby retaining the packing between the bore and the member, the system comprising:

a locking device having a portion thereof adapted to be positioned within at least one of the plurality of apertures of the packing nut, thereby connecting the locking device to the packing nut; and an engagement device adapted to be connected to the locking device for engagement of the housing, thereby securely engaging the locking device to the housing, and thus, preventing rotation of the packing nut relative to the housing.

5. The self-tightening retaining system as set forth in claim 4, wherein the housing is a pump housing and the member is a pony rod.

6. A self-tightening retaining system as set forth in claim 4, further comprising:

a plurality of apertures located in and extending through the locking device adapted to be at an angle substantially parallel to the axis when the locking device is connected to the packing nut; and wherein the engagement device further comprises a plurality of set screws, each set screw adapted to be positioned within each of the plurality of apertures of the locking device, the plurality of set screws having threads interengageable with the threads of the plurality of apertures of the locking device to allow for the plurality of set screws to be tightened into frictional engagement with the housing, thereby preventing rotation of the locking device relative to the housing, and thus, preventing the rotation of the packing nut relative to the housing when the locking device is connected to the packing nut.

7. A self-tightening retaining system as set forth in claim 4, wherein the locking device comprises:

a body having a substantially cylindrical portion; and wherein the substantially cylindrical portion is geometrically complimentary to and is adapted to be received within at least one of the plurality of apertures of the packing nut to thereby connect the locking device to the packing nut.

8. A self-tightening retaining system as set forth in claim 7, further comprising:

a plurality of apertures located in and extending through the locking device body adapted to be at an angle substantially parallel to the axis when the locking device is connected to the packing nut; and wherein the engagement device further comprises a plurality of set screws, each set screw adapted to be positioned within each of the plurality of apertures of the locking device, the plurality of set screws having threads interengageable with the threads of the plurality of apertures of the locking device to allow for the plurality of set screws to be tightened into frictional engagement with the housing, thereby preventing rotation of the locking device relative to the housing when the locking device is connected to the packing nut.

9. A retaining system for securing a closure at an installed position within a bore, the bore being in a portion of a housing, the closure in the installed position closes the bore, the bore having screw threads along at least a portion of the bore and the closure having an internally threaded hole extending into the closure, the system comprising:

a retaining cover for obstructing removal of the closure from the bore, the cover being receivable in the bore in a position generally adjacent the closure and having external threads interengageable with the screw threads of the bore such that the cover is rotatable relative to the housing in a tightening direction for movement of the cover into the bore toward the closure and rotatable in an opposite, loosening direction for movement of the cover out from the bore away from the closure, the cover having a central axis of rotation, the cover having a polygonal shaped central opening extending therethrough defining an internal wall along the opening;

a locking member configured for being secured to the cover, the locking member having a polygonal shape and an outer surface which forms a radial abutment along the internal wall of the cover for nesting engagement within the central opening of the cover, and against rotation of the cover relative to the locking member, the locking member having a central clearance bore located in and extending therethrough;

at least one rotatable engagement device extending through at least one aperture in the locking member, adapted for frictional engagement of the closure, thereby securely engaging the locking member to the closure; and a fastener receivable in the central clearance bore of the locking member and the hole of the closure and having external threads interengageable with threads of the hole.

10. The self-tightening retaining system as set forth in claim 9, wherein the housing is a pump housing and the retaining cover is a pump access port cover.

11. The self-tightening retaining system as set forth in claim 9, wherein the at least one rotatable engagement device comprises a set screw.

12. The self-tightening retaining system as set forth in claim 9, wherein the locking member comprises a nut.

13. The self-tightening retaining system set forth in claim 12, wherein the fastener comprises a threaded bolt extending through the nut.

14. The self-tightening retaining system as set forth in claim 13, wherein the bolt is aligned with the central axis of rotation of the cover.

15. A method of locking a threaded nut at a position within a bore of a pump housing of a reciprocating pump, the method comprising the steps of:

(a) engaging a portion of a block with the threaded nut; and (b) engaging at least one set screw positioned within at least one aperture in the block with a non-rotatable portion of the reciprocating pump, thereby preventing rotation of the threaded nut relative to the pump housing, and thus, preventing rotation of the threaded nut relative to the pump housing.

16. The method of claim 15, wherein the threaded nut has a polygonal shaped central opening extending therethrough, defining an internal wall along the opening; and wherein the block is polygonal in shape; and wherein step (a) further comprises:

positioning the block within the central opening such that the block is in nesting engagement with the threaded nut.

17. The method of claim 16, further comprising after step (a), but before step (b):

inserting a fastener through a central clearance bore in the block and into threading engagement with a hole in a closure, the closure being positioned within the bore; and wherein step (b) further comprises:

engaging the at least one set screw within the at least one aperture in the block with a portion of the closure, thereby preventing rotation of the block relative to the closure, and thus, preventing rotation of the threaded nut relative to the pump housing.

18. The method of claim 15, wherein step (a) further comprises:

inserting a substantially cylindrical portion of the block into at least one of a plurality of apertures extending around the outer peripheries of the threaded nut to thereby connect the block to the threaded nut.

19. The method of claim 18, wherein step (b) further comprises:

engaging the at least one set screw within the at least one aperture in the block with a portion of the pump housing, thereby preventing rotation of the block relative to the pump housing, and thus preventing rotation of the threaded nut relative to the pump housing.

* * * * *